US005266865A

United States Patent [19]

Haizumi et al.

[11] Patent Number: 5,266,865

[45] Date of Patent: Nov. 30, 1993

[54] STRUCTURE OF LEAD CONDUCTOR FOR THIRD ELECTRODE OF THREE-ELECTRODE TYPE ELECTROLUMINESCENT LAMP

[75] Inventors: Masahiro Haizumi; Hisahumi Tanaka; Hiromu Yamada; Kazuhisa Sawada, all of Shiga, Japan

[73] Assignee: NEC Corporation, Tokyo, Japan

[21] Appl. No.: 570,533

[22] Filed: Aug. 21, 1990

[30] Foreign Application Priority Data

Aug. 22, 1989 [JP] Japan ..... 1-098323[U]
Dec. 25, 1989 [JP] Japan ..... 1-149814[U]

[51] Int. Cl.[5] ..... H01J 1/62

[52] U.S. Cl. ..... 313/506; 313/51; 313/313; 313/509; 313/512

[58] Field of Search ..... 313/51, 506, 509, 503, 313/512, 313, 306, 269, 511; 315/169.3; 174/35 MS File, 35 R; 445/24

[56] References Cited

U.S. PATENT DOCUMENTS 4,745,334 5/1988 Kawachi ..... 313/512
4,777,402 10/1988 Mitsumori ..... 313/509
4,959,590 9/1990 Hatada et al. ..... 315/169.3

*Primary Examiner*—Donald J. Yusko
*Assistant Examiner*—N. D. Patel
*Attorney, Agent, or Firm*—Leydig, Voit & Mayer

[57] ABSTRACT

A three-electrode type electroluminescent lamp has a transparent electrode connected to a rear side lead conductor, and an electroluminescent body sandwiched between the transplant electrode and the backing electrode. A third plate-like electrode is laid over the backing electrode in an electrical insulation relation with the backing electrode, and a third lead conductor is formed of an integral extension of the third electrode. The integral extension of the third electrode extends outwardly from an edge of the third electrode near to the edge region of the transparent electrode connected to the base end portion of the first lead conductor, so as to avoid the edge region of the transparent electrode on which the base end portion of the first lead conductor is laid and also to extend along the first lead conductor excluding the base end portion. A printed-wiring board having a plurality of printed wirings is mounted on the electroluminescent lamp. The third lead conductor is electrically connected at its tip end to a corresponding one of the printed wirings by a mechanical solderless connection using a clamping member.

16 Claims, 5 Drawing Sheets

STRUCTURE OF LEAD CONDUCTOR FOR THIRD ELECTRODE OF THREE-ELECTRODE TYPE ELECTROLUMINESCENT LAMP

BACKGROUND OF THE INVENTION

1. Field of the Invention

The present invention relates to an electroluminescent lamp of a three-electrode structure which can be effectively used for example as a back light for a liquid crystal display, and more specifically, to a structure of a lead conductor for a so-called "third electrode" of the three-electrode type electroluminescent lamp.

2. Description of Related Art

In the prior art, an electroluminescent lamp having a three-electrode structure effective in preventing mechanical vibration or noise and in giving an electrostatic shield has been known. Referring to FIGS. 1 and 2, there are diagrammatically shown a plan view and a sectional view of one three-electrode type electroluminescent lamp which is known to the inventors but has not yet been known to public.

The electroluminescent lamp is generally indicated by Reference Numeral 10, and includes an electroluminescent panel 12 consisting of a phosphor dispersed organic sheet-like member 14 sandwiched between a transparent sheet-like electrode 16 and a backing metal electrode 18. The transparent electrode 16 constitutes a front side electrode through which a light emitted from the phosphor is outputted. The backing electrode 18 constitutes a rear side electrode having a function of reflecting the light emitted from the phosphor toward the transparent electrode. A base end 20A of a first or front side lead conductor 20 is laid over an edge region of the transparent electrode 16 and electrically connected to the edge region of the transparent electrode 16. The front side lead conductor 20 extends outwardly from the edge region of the transparent electrode 16. A base end 22A of a second or rear side lead conductor 22 is laid over and electrically connected to an edge region of the backing electrode 18 at the same side as that of the edge region of the transparent electrode 16 connected to the base end 20A of the lead conductor 20. A connection position between the base end 22A of the rear side lead conductor 22 and the backing electrode 18 is shifted apart from a connection position between the transparent electrode 16 and the lead conductor 20 in a direction along the edge of the backing electrode 18. The rear side lead conductor 22 extends outwardly from the edge region of the backing electrode 18 in parallel to the front side lead conductor 20.

The above mentioned electroluminescent panel 12 is enclosed and sealed within an enclosure which is formed of a transparent insulative film 24 and a rear side insulative film 26 bonded at their periphery to each other.

On a rear surface of the electroluminescent lamp, namely, on the rear side insulative film 26, a sheet-like "third electrode" assembly 28 is bonded for example by a both-surface adhesive tape (not shown). This third electrode assembly 28 includes a metal sheet 30 sandwiched between and laminated with a pair of protection films 32 and 34. For electrical connection, a base end of 36A of a third lead conductor 36 is laid over and electrically connected to an edge region of the metal sheet 30 at the same side as that of the edge region of the transparent electrode 16 connected to the base end 20A of the lead conductor 20 and at a position corresponding to a connection position between the transparent electrode 16 and the front side lead conductor 20. The third lead conductor 36 extends outwardly from the edge region of the metal sheet 30 so as to overlap the front side lead conductor 20 as shown in the plan view of in FIG. 1 when the third electrode assembly 28 is bonded to the electroluminescent panel 12.

With the above mentioned arrangement, the third lead conductor 36 extending from the third electrode assembly 28 is electrically connected to the front side lead conductor 20 extending from the transparent electrode 16. This connection puts the third electrode at the same potential as that of the transparent electrode 16. As a result, generation of mechanical vibration or noise is effectively suppressed, and an electrostatic shield is attained.

However, as seen from the plan view of FIG. 1, the third electrode assembly 28 is bonded to the electroluminescent lamp 10 in such a manner that the third lead conductor 36 overlaps the base end 20A of the front side lead conductor 20, namely a stacked connection portion between the transparent electrode 16 and the front side lead conductor 20. Therefore, a thickness of the stacked connection portion between the transparent electrode 16 and the front side lead conductor 20 has been apparently increased by a thickness of the third lead conductor. As a result, the overall thickness of the electroluminescent lamp apparatus has been correspondingly increased.

In addition, the third lead conductor 36 is fabricated independently of the metal sheet 30 of the third electrode assembly 28, and mechanically fixed and electrically connected to the metal sheet 30. If the third lead electrode 36 were previously shaped to avoid or detour the stacked connection portion 20A between the transparent electrode 16 and the front side lead conductor 20, the third lead electrode 36 thus shaped would become difficult to handle, and the cost for manufacturing the third lead electrode 36 would be increased. Therefore, even if this method were effective in decreasing the overall thickness of the electroluminescent lamp apparatus, it is not so practical.

Another example of the three-electrode type electroluminescent lamps known to the inventors has been provided with a printed-wiring board on which a connector is mounted or connection pads are formed for an external connection. One typical example of printed-wiring board has first, second and third printed wirings extending from a connector mounted region toward an edge of the printed-wiring board. A front side lead conductor, which is electrically connected at one end to a transparent electrode of electroluminescent lamp, is soldered at its other end to the first printed wiring of the printed-wiring board, and a rear side lead conductor, which is electrically connected at one end to a backing electrode of electroluminescent lamp, is also soldered at its other end to the second printed wiring of the printed-wiring board. Furthermore, a third lead conductor, which is electrically connected at one end to a so called third electrode, is also soldered at its other end to the third printed wiring.

As mentioned above, the front side lead conductor, the rear side lead conductor and the third lead conductor are soldered to the corresponding printed wirings on the printed-wiring board. Therefore, the front side, rear side and third lead conductors must have been made of a solderable metal. Therefore, if it is considered to constitute the third lead conductor with an extension of the third electrode, the third electrode would have to be formed of metal.

Here, consider respective functions of the front side lead conductor for the transparent electrode, the rear side lead conductor for the backing electrode and and the third lead conductor for the third electrode. The front side and rear side lead conductors are terminals for supplying a voltage required to cause the electroluminescent lamp to emit a light, and therefore, the front side and rear side lead conductors would have to be formed of metal and to be soldered to the printed wirings, as in to the conventional electroluminescent lamps, in order to ensure a required low connection resistance and a required reliability. However, as explained hereinbefore, the third electrode is provided for prevention of the mechanical vibration or noise and for the electrostatic shield, and therefore, it is sufficient if the third lead conductor makes it possible to maintain the third electrode at the same potential as that of the front side or transparent electrode. In other words, the third lead conductor is not necessarily formed of a material such as a metal which has a low electric resistance and which enables soldering. Therefore, if it is considered to constitute the third lead conductor with an extension of the third electrode, the third electrode must be formed of a relatively expensive material such as metal.

SUMMARY OF THE INVENTION

Accordingly, it is an object of the present invention to provide a three-electrode type electroluminescent lamp which has overcome the defects of the above mentioned three-electrode type electroluminescent lamps.

Another object of the present invention is to provide a structure of a lead conductor for a third electrode of a three-electrode type electroluminescent lamp, enabling to decrease the overall thickness of the electroluminescent lamp apparatus.

A further object of the present invention is to provide a connection structure of a lead conductor for a third electrode of a three-electrode type electroluminescent lamp provide with a printed-wiring board, enabling to use an inexpensive material for the third electrode.

The above and other objects of the present invention are achieved in accordance with the present invention by a three-electrode type electroluminescent lamp comprising a transparent electrode, a backing electrode, an electroluminescent body sandwiched between the transparent electrode and the backing electrode, a first lead conductor having a base end portion laid over and electrically connected to one edge region of the transparent electrode, a second lead conductor having a base end connected to the backing electrode, a third electrode in the form of a plate laid over the backing electrode in an electrical insulation relation from the backing electrode, and a third lead conductor formed of an integral extension of the third electrode, the integral extension of the third electrode extending from an edge of the third electrode near to the edge region of the transparent electrode connected to the base end of the first lead conductor, so as to detour the edge region of the transparent electrode on which the base end portion of the first lead conductor is laid and also to extend along the first lead conductor excluding the base end portion.

With the above mentioned arrangement, the third lead conductor of the third electrode, which can avoid from overlapping the stacked connection portion between the transparent electrode and the front side lead conductor of the electroluminescent lamp, can be easily and inexpensively realized, since the third lead conductor is previously formed integrally with the third electrode body. Therefore, it is possible to easily and inexpensively decrease the overall thickness of the electroluminescent lamp apparatus.

According to another aspect of the present invention, there is provided a three-electrode type electroluminescent lamp comprising a transparent electrode, a backing electrode, an electroluminescent body sandwiched between the transparent electrode and the backing electrode, a third electrode in the form of a plate laid over the backing electrode in an electrical insulation relation from the backing electrode, a printed-wiring board mounted on the electroluminescent lamp and having a plurality of printed wirings, a first lead conductor having one end electrically connected to the transparent electrode and the other end electrically connected to a corresponding one of the printed wirings of the printed-wiring board, a second lead conductor having one end electrically connected to the backing electrode and the other end electrically connected to a corresponding one of the printed wirings of the printed-wiring board, a third lead conductor extending from the backing electrode and having a tip end electrically connected to a corresponding one of the printed wirings of the printed-wiring board by a mechanical solderless connection using a clamping member.

With the above arrangement, it is no longer necessary to use solderable metal for the lead conductor of the third electrode, and therefore, it is possible to use an inexpensive material for the lead conductor of the third electrode. The inexpensive material used for the lead conductor of the third electrode includes a conductive material such as a carbon paste deposited on an insulative film and an inexpensive metal such as aluminum.

Preferably, the mechanical solderless connection is a pressure solderless connection, and the clamping member is composed of a staple or a grommet. The pressure solderless connection is more excellent in workability than the soldering, and therefore, is effective in reducing the manufacturing cost.

The above and other objects, features and advantages of the present invention will be apparent from the following description of preferred embodiments of the invention with reference to the accompanying drawings.

DESCRIPTION OF THE PREFERRED EMBODIMENTS

Figure 1:
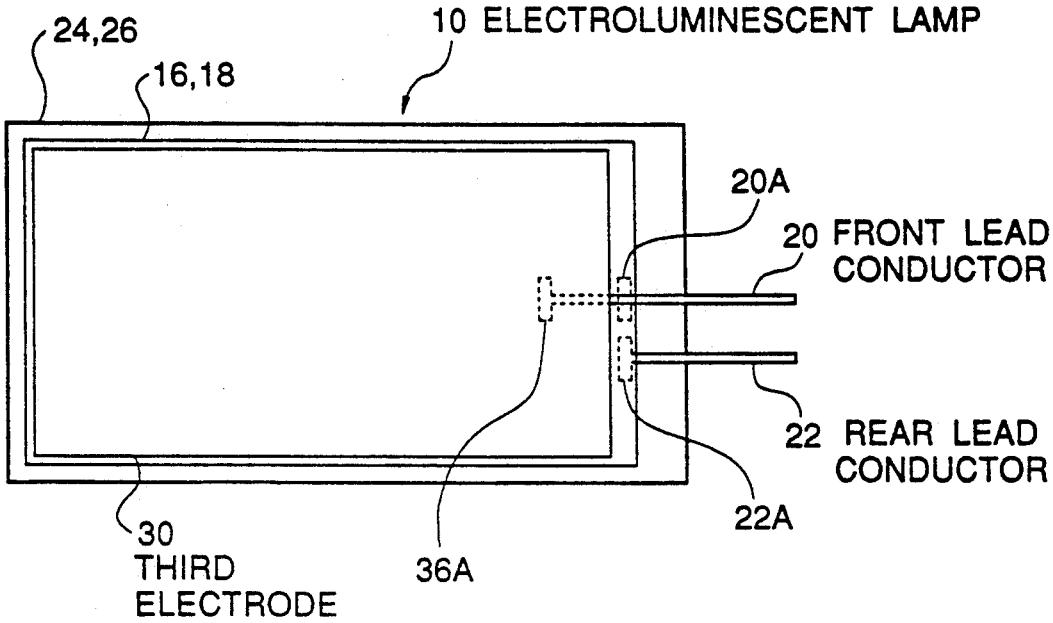
FIG. 1 is a diagrammatic plan view of a three-electrode type electroluminescent lamp known to the inventors.
Figure 2:
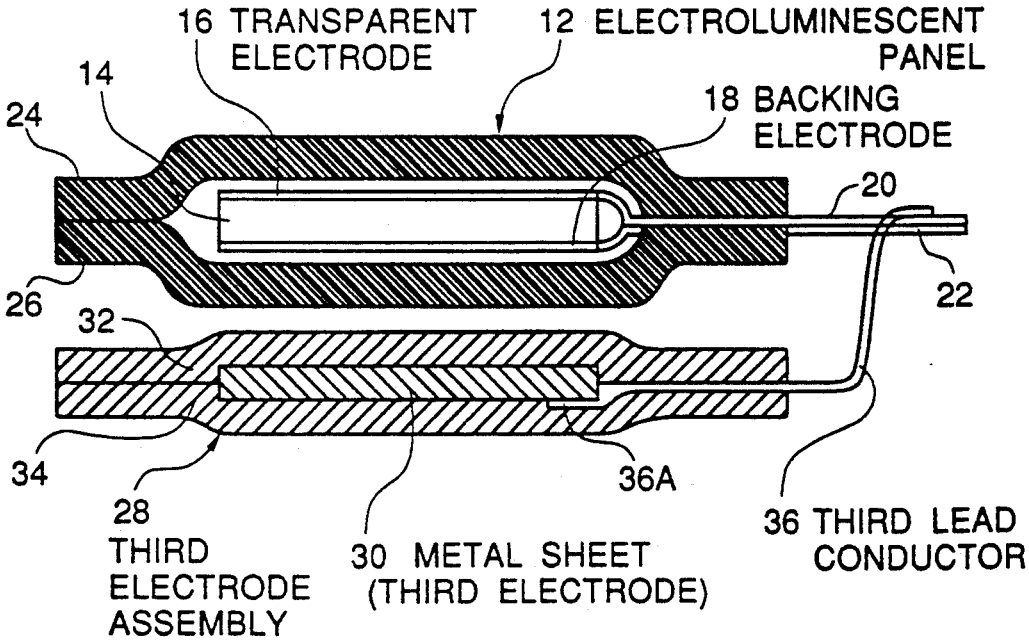
FIG. 2 is a diagrammatic sectional view of a three-electrode type electroluminescent lamp known to the inventors.
Figure 3:
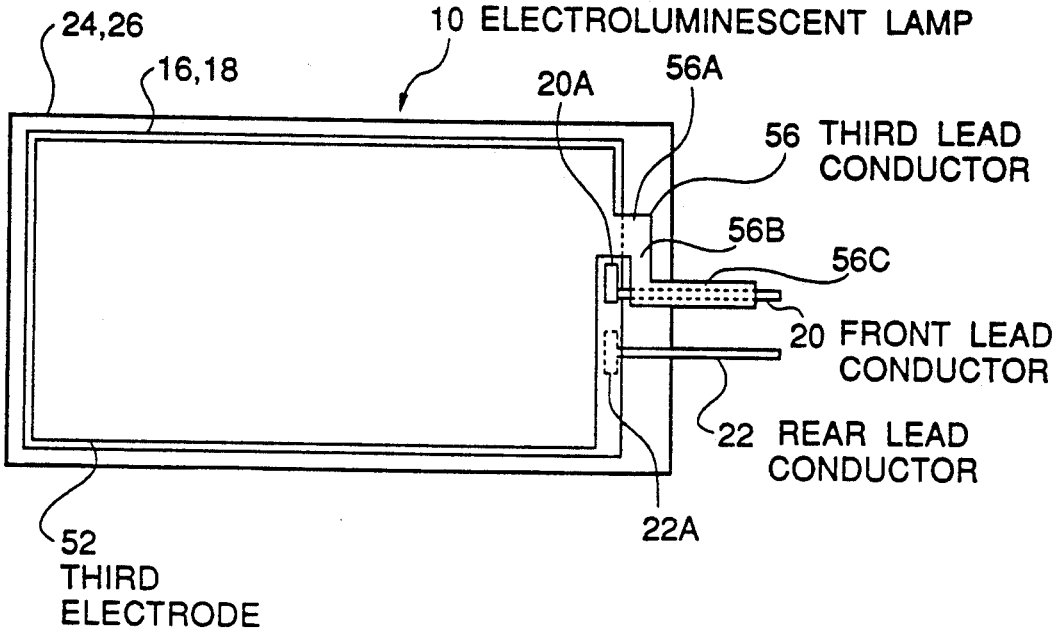
FIG. 3 is a diagrammatic plan view of one embodiment of the three-electrode type electroluminescent lamp in accordance with the present invention.

Referring to FIG. 3, there is shown a diagrammatic plan view of one embodiment of the three-electrode type electroluminescent lamp in accordance with the present invention. Furthermore, referring to FIG. 4, there is shown a diagrammatic sectional view of the third electrode assembly used in the one embodiment of the three-electrode type electroluminescent lamp in accordance with the present invention. In these drawings, elements similar to those shown in FIGS. 1 and 2 are given the same Reference Numerals, and explanation thereof will be omitted. The electroluminescent lamp 10 is the same as that shown in FIGS. 1 and 2.

The shown third electrode assembly is generally indicated with Reference Numeral 50, and includes a rectangular metal sheet 52 having a shape corresponding to that of the electrodes of the electroluminescent lamp 10, as shown in FIG. 3. This rectangular metal sheet 52 constitutes a third electrode. The rectangular metal sheet 52 has an extension 56 integral with the rectangular metal sheet 52 and shaped or patterned to extend so as to avoid the stacked connection portion 20A between the transparent electrode 16 and the front side lead conductor 20 of the electroluminescent lamp. Specifically, the extension 56 is composed of a first portion 56A outwardly extending from an edge region of the rectangular metal sheet 52 shifted apart from the connection position 20A between the transparent electrode 16 and the lead conductor 20, a second portion 56B extending from a tip end of the first portion 56A in parallel to an edge of the rectangular metal sheet 52 toward the front side lead conductor 20, and a third portion 56C extending from a tip end of the second portion 56B along the front side lead conductor 20. In the above mentioned arrangement, the extension 56 forms a third lead conductor for the third electrode.

Figure 4:
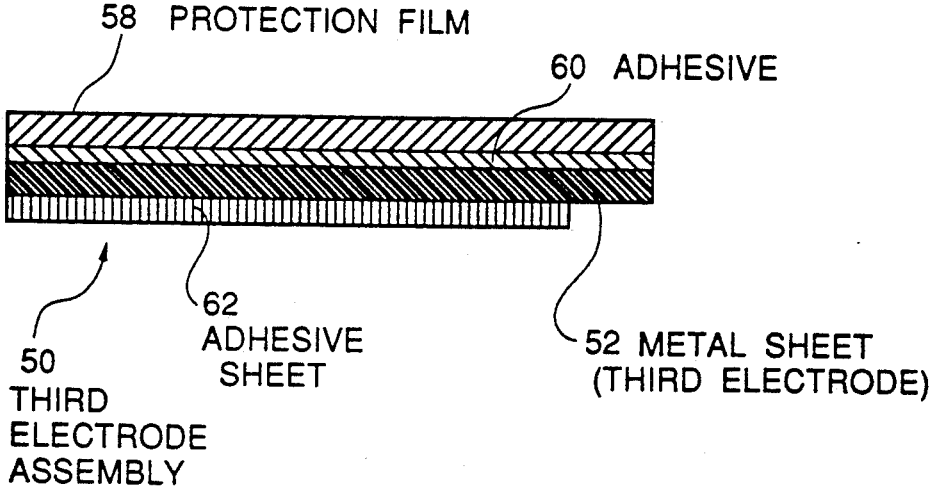
FIG. 4 is a diagrammatic sectional view of the third electrode assembly used in the one embodiment of the three-electrode type electroluminescent lamp in accordance with the present invention.

As shown in FIG. 4, an insulative protection film 58 is bonded to one surface of the rectangular metal sheet 52 by means of an adhesive 60 so as to cover the one surface of the rectangular metal sheet 52. To the other surface of the metal sheet 52, an adhesive sheet 62 is laminated excepting a portion of the extension 56 electrically connected to the front side lead conductor 20 so that the third electrode assembly 50 can be laminated and bonded to the electroluminescent lamp 10 by the adhesive sheet 62.

First, the third electrode assembly 50 is positioned in alignment with the electroluminescent lamp 10 in such a manner that the third lead conductor, particularly the third portion 56C of the extension 56 overlaps the front side lead conductor 20, and thereafter, the third electrode assembly 50 is bonded to the electroluminescent lamp 10 by the adhesive sheet 62. The third portion 56C of the extension 56 is electrically connected to the front side lead conductor 20, by means of, for example, soldering, a conductive bonding agent, or pressure solderless connection. Thus, the three-electrode type electroluminescent lamp is finished.

With the above mentioned three-electrode type electroluminescent lamp, an AC voltage is applied between the front side lead conductor 20 and the rear side lead conductor 22, so that a light is emitted from the electroluminescent lamp. At this time, mechanical vibration or noise generated in the three-electrode type electroluminescent lamp is sufficiently lower than that generated in a conventional electroluminescent lamp of a two-electrode structure. In addition, electric noise adversely influencing the other electric circuits is effectively suppressed by an electrostatic shield realized by cooperation of the third electrode and the transparent electrode.

In addition, since the third lead conductor formed of the extension 56 extends apart from or detours around the stacked connection portion 20A between the transparent electrode 16 and the front side lead conductor 20, the thickness of the electroluminescent lamp apparatus in the stacked connection portion 20A between the transparent electrode 16 and the front side lead conductor 20 will never be remarkably increased in comparison with other portions of the electroluminescent lamp. Therefore, the overall thickness of the electroluminescent lamp apparatus can be reduced in comparison with the conventional electroluminescent lamp apparatus of the three-electrode structure.

Figure 5:
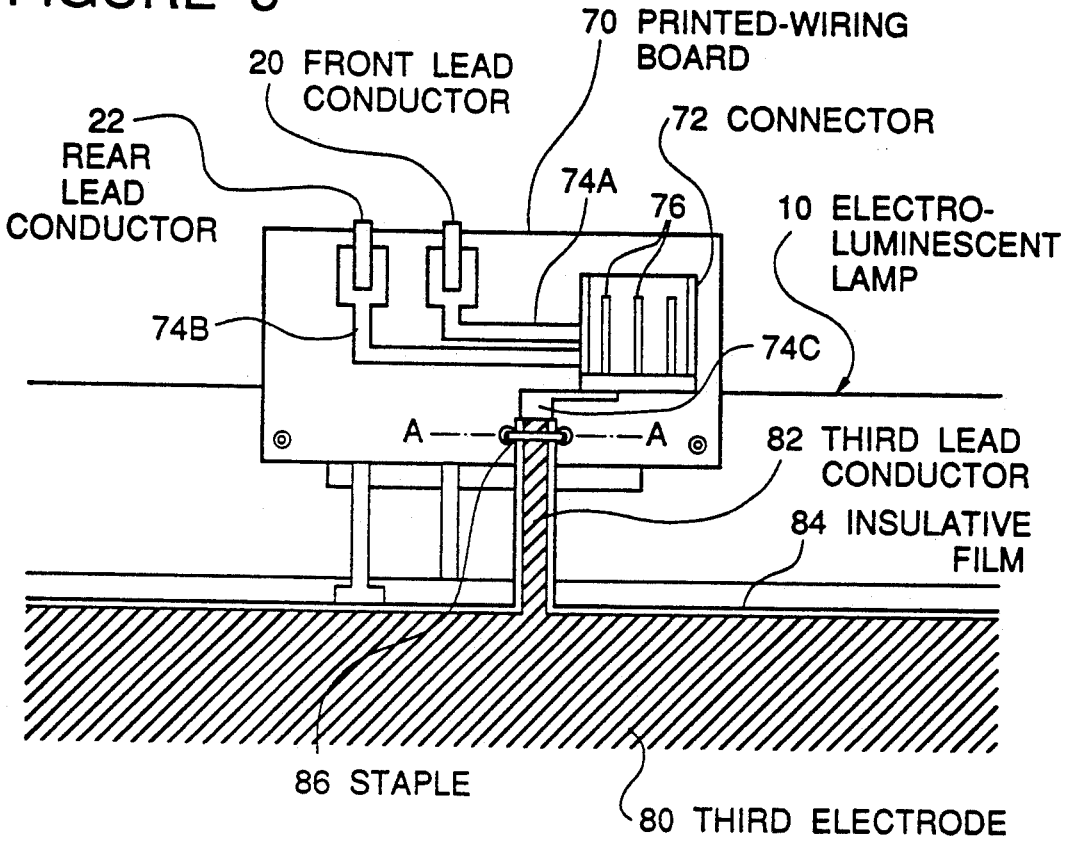
FIG. 5 is a diagrammatic partial plan view of a printed-wiring board mounted on and connected to the three-electrode type electroluminescent lamp, illustrating another embodiment of the three-electrode type electroluminescent lamp in accordance with the present invention.

Referring to FIG. 5, there is shown a diagrammatic partial plan view of a printed-wiring board mounted on and connected to the three-electrode type electroluminescent lamp illustrating another embodiment of the third lead conductor connection structure in accordance with the present invention. Further, referring to FIG. 6, there is shown a diagrammatic enlarged sectional view taken along the line A—A in FIG. 5. In these drawings, elements similar or functionally corresponding to those shown in FIGS. 3 and 4 are given the same Reference Numerals, and explanation thereof will be omitted.

A printed-wiring board 70 is mounted on a peripheral portion of the electroluminescent lamp 10, preferably on a peripheral portion of of the enclosing insulative films 24 and 26 outside the transparent electrode 16 and the backing electrode 18. A connector 72 for an external connection is mounted on a front surface of the board 70. The printed-wiring board 70 has three printed wirings 74A, 74B and 74C which are formed on the front surface of the board 70, and which extend from a region underneath the connector 72 toward an edge of the board 70. Contacts 76 of the connector 72 are electrically connected to corresponding printed wirings 74A, 74B and 74C underneath the connector 72 by for example soldering. A pair of through holes 78 are perforated in the printed-wiring board 72 at opposite sides of an end portion of the printed wiring 74C.

On the other hand, a third electrode 80 and a third lead conductor 82 integrally extending therefrom are formed of for example a layer of carbon paste printed on an insulative film 84.

The third electrode 80 is aligned and bonded to the electroluminescent lamp 10 in such a manner that the insulative film 84 is positioned outside and the third lead conductor 82 is in alignment with the end portion of the printed wiring 74C. A staple 86 is driven so as to straddle a lapped portion of the third lead conductor 82 and the corresponding printed wirings 74C so that a pair of legs of the staple 84 are inserted into the through-holes 78 and a tip end portion of each leg are folded back at a rear surface of the printed-wiring board 70. As a result, the third lead conductor 82 is pressed into stable mechanical and electric contact with the printed wiring 74C.

On the other hand, the front side lead conductor 20 and the rear side lead conductor 22 pass on the rear surface side of the printed-wiring board 70, and folded back to the front surface of the printed-wiring board 70 so that respective tip ends of the front side lead conductor 20 and the rear side lead conductor 22 are soldered to respective end portions of corresponding printed wirings 74A and 74B.

As mentioned above, the third electrode 80 and the third lead conductor 82 integrally extending therefrom are formed of the layer of carbon paste printed on the insulative film 84. Therefore, since the third electrode 80 and the third lead conductor 82 are not formed of a solderable metal such as gold foil, the third electrode 80 and the third lead conductor 82 can be formed with an inexpensive cost. In addition, even if the third electrode 80 and the third lead conductor 82 are formed of a metallic material similarly to the conventional ones, the pressure solderless connection using the staple and other means are easy to work, in comparison with the soldering.

Figure 6:
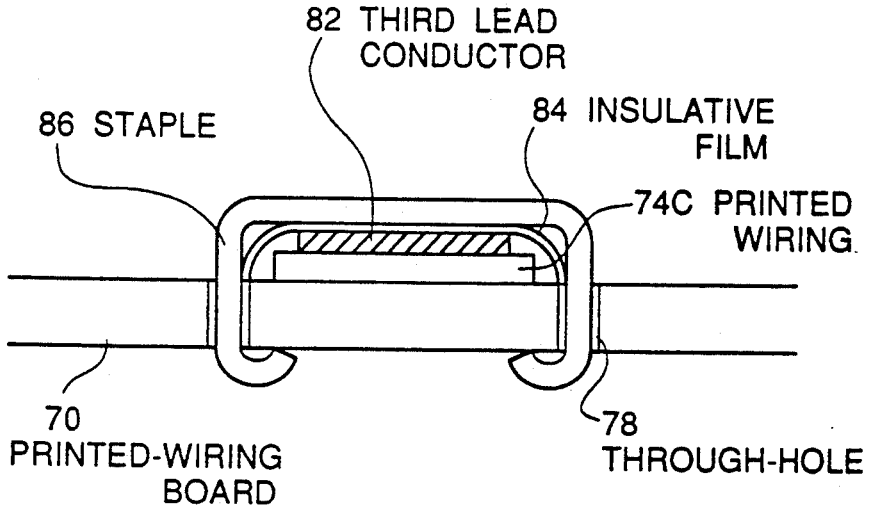
FIG. 6 is a diagrammatic enlarged sectional view taken along the line A—A in FIG. 5.
Figure 7:
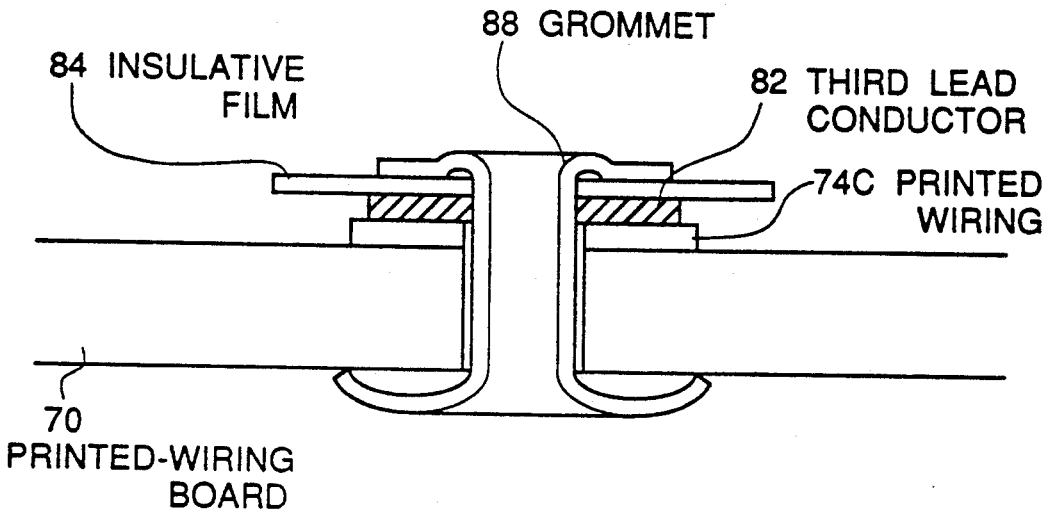
FIG. 7 is a diagrammatic enlarged sectional view similar to FIG. 6 but showing another pressure solderless connection between the third lead conductor and the printed wiring.

Referring to FIG. 7, there is a diagrammatic enlarged sectional view similar to FIG. 6 but showing another pressure solderless connection between the third lead conductor and the printed wiring. In FIG. 7, elements similar to those shown in FIG. 6 are given the same Reference Numerals and explanation thereof will be omitted.

As could be understood from FIG. 7, a grommet 88 can be used in place of the staple 86. The grommet 88 is driven to penetrate a lapped portion of the third lead conductor 82 and the printed wiring 74C and the printed-wiring board, so that the third lead conductor 82 is pressed into stable electric contact with the printed wiring 74C. The grommet 88 makes a space required for the pressure solderless connection smaller than that required in the staple.

Figure 8:
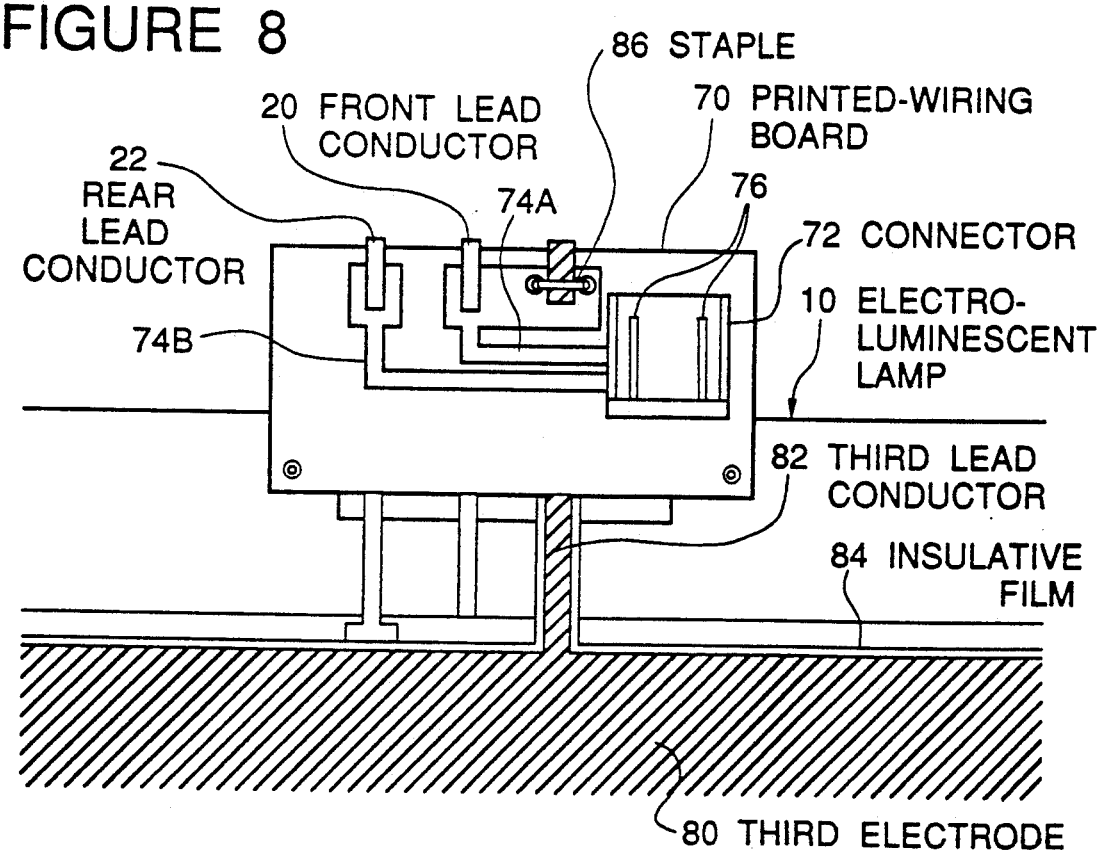
FIGS. 8 and 9 are diagrammatic partial plan view similar to FIG. 5 but showing different embodiments of the third lead conductor connection structure in accordance with the present invention, respectively.
Figure 9:
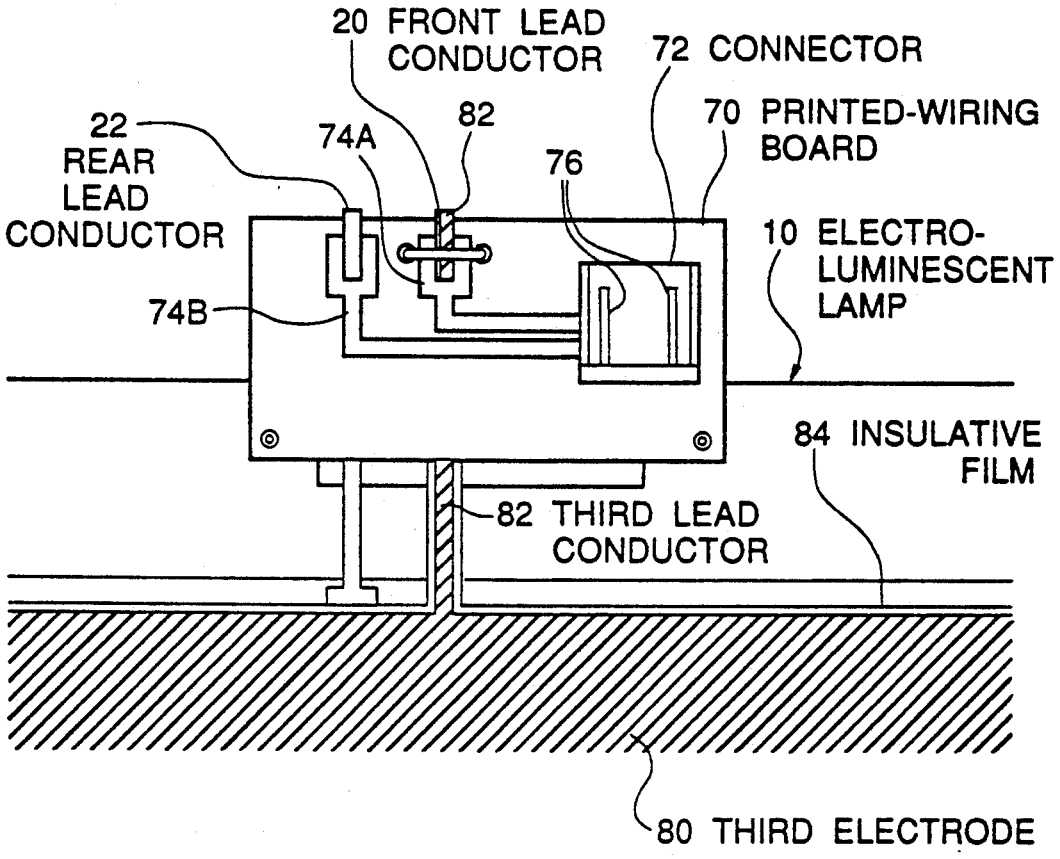

FIGS. 8 and 9 show different embodiments of the third lead conductor connection structure in accordance with the present invention, respectively. In these drawings, elements similar to those shown in FIG. 5 are given the same Reference Numerals, and explanation thereof will be omitted.

In the embodiment shown in FIG. 8, the end portion of the printed wiring 74A connected to the front side lead conductor 20 is enlarged, and the third lead conductor 82 is electrically connected to the enlarged end portion of the printed wiring 74A by the staple 86. Namely, the front side lead conductor 20 and the third lead conductor 82 are electrically connected to the same printed wiring 74A. Therefore, the printed wiring 74C is omitted, and the connector 72 has only two contacts. In other words, the printed-wiring board 70 can be said to be of a two-terminal type.

When the electroluminescent lamp is put in use, since the third electrode is brought to the same potential as the transparent electrode, it is convenient that the front side lead conductor 20 and the third lead conductor 82 are previously electrically connected to each other on the printed-wiring board 70.

In the embodiment shown in FIG. 9, the third lead conductor 82 is lapped over and electrically connected to the front side lead conductor 20 lapped over and electrically connected to the end portion of the printed wiring 74A. In this case, the enlarged end portion of the printed wiring 74A is not necessary, and therefore, the connection space required for the three lead conductors can be reduced.

In the above mentioned embodiments, the connector 72 is mounted on the printed-wiring board 70. However, it is possible to omit the connector and to modify the printed wirings so that each of the printed wirings has a connection pad to which an external connection conductor is soldered.

The invention has thus been shown and described with reference to the specific embodiments. However, it should be noted that the present invention is in no way limited to the details of the illustrated structures but changes and modifications may be made within the scope of the appended claims.

We claim:

1. A three-electrode type electroluminescent lamp comprising a transparent electrode, a backing electrode, an electroluminescent body sandwiched between said transparent electrode and said backing electrode, a first lead conductor having a base end portion laid over and electrically connected to one edge region of said transparent electrode, a second lead conductor having a base end connected to said backing electrode, a third electrode in the form of a plate laid over said backing electrode in an electrical insulation relation from said backing electrode, and a third lead conductor formed of an integral extension of said third electrode, said integral extension of said third electrode extending outwardly from an edge of said third electrode near to said edge region of said transparent electrode connected to said base end portion of said first lead conductor, so as to avoid said edge region of said transparent electrode on which said base end portion of said first lead conductor is laid and also to extend along said first lead conductor excluding said base end portion.

2. An electroluminescent lamp claimed in claim 1 wherein said backing electrode has a first surface facing to said electroluminescent body and a second surface which is opposite to said first surface and which is covered with an insulating cover, and said third electrode is stuck to said second surface of said backing electrode by an adhesive sheet.

3. An electroluminescent lamp claimed in claim 2 wherein said third electrode is covered with a protection film which is bonded to said third electrode by a layer of adhesive.

4. An electroluminescent lamp claimed in claim 1 wherein said third electrode is formed of one sheet of metal film patterned to have a main portion having a size and a shape corresponding to those of said backing electrode.

5. An electroluminescent lamp claimed in claim 1 further including a printed-wiring board mounted on the electroluminescent lamp and having a plurality of printed wirings, and wherein said first lead conductor is electrically connected at its tip end to a corresponding one of said printed wirings, said second lead conductor is electrically connected at its tip end to a corresponding one of said printed wirings, said third lead conductor is electrically connected at its tip end to a corresponding one of said printed wirings by a mechanical solderless connection using a clamping member.

6. An electroluminescent lamp claimed in claim 5 wherein the mechanical solderless connection is a pressure solderless connection.

7. An electroluminescent lamp claimed in claim 5 wherein said tip end of said third lead conductor is lapped over said corresponding one of said printed wirings, and pressed to said corresponding one of said printed wirings by means of a staple driven into said printed-wiring board so as to straddle a lapped portion of said third lead conductor and said corresponding one of said printed wirings, so that said third lead conductor is in stable mechanical and electrical contact with said corresponding one of said printed wirings.

8. An electroluminescent lamp claimed in claim 5 wherein said tip end of said third lead conductor is lapped over said corresponding one of said printed wirings, and pressed to said corresponding one of said printed wirings by means of a grommet driven to penetrate a lapped portion of said third lead conductor and said corresponding one of said printed wirings and said printed-wiring board, so that said third lead conductor is in stable mechanical and electrical contact with said corresponding one of said printed wirings.

9. A three-electrode type electroluminescent lamp comprising a transparent electrode, a backing electrode, an electroluminescent body sandwiched between said transparent electrode and said backing electrode, a third electrode in the form of a plate laid over said backing electrode in an electrical insulation relation with said backing electrode, a printed-wiring board mounted on the electroluminescent lamp and having a plurality of printed wirings, a first lead conductor having one end electrically connected to said transparent electrode and the other end electrically connected to a corresponding one of said printed wirings of the said printed-wiring board, a second lead conductor having one end electrically connected to said backing electrode and the other end electrically connected to a corresponding one of said printed wirings of the said printed-wiring board, a third lead conductor extending from said backing electrode and having a tip end electrically connected to a corresponding one of said printed wirings of the said printed-wiring board by a mechanical solderless connection using a clamping member.

10. An electroluminescent lamp claimed in claim 9 wherein said third electrode and said third lead conductor extending therefrom are composed of a layer of non-metallic conductive material printed on an insulative film.

11. An electroluminescent lamp claimed in claim 10 wherein said non-metallic conductive material is formed of carbon paste.

12. An electroluminescent lamp claimed in claim 9 wherein the mechanical solderless connection is a pressure solderless connection.

13. An electroluminescent lamp claimed in claim 9 wherein said tip end of said third lead conductor is lapped over said corresponding one of said printed wirings, and pressed to said corresponding one of said printed wirings by means of a staple driven into said printed-wiring board so as to straddle a lapped portion of said third lead conductor and said corresponding one of said printed wirings, so that said third lead conductor is in stable mechanical and electrical contact with said corresponding one of said printed wirings.

14. An electroluminescent lamp claimed in claim 9 wherein said tip end of said third lead conductor is lapped over said corresponding one of said printed wirings, and pressed to said corresponding one of said printed wirings by means of a grommet driven to penetrate a lapped portion of said third lead conductor and said corresponding one of said printed wirings and said printed-wiring board, so that said third lead conductor is in stable mechanical and electrical contact with said corresponding one of said printed wirings.

15. A three-electrode type electroluminescent lamp comprising:

a transparent electrode;

a backing electrode;

an electroluminescent body sandwiched between said transparent electrode and said backing electrode;

a third electrode in the form of a plate laid over said backing electrode and electrically insulated from said backing electrode, said third electrode having an equivalent potential to said transparent electrode;

a printed-wiring board mounted on the electroluminescent lamp and having a plurality of printed wirings;

a first lead conductor having one end electrically connected to said transparent electrode and the other end electrically connected to a corresponding one of said printed wirings of said printed-wiring board;

a second lead conductor having one end electrically connected to said backing electrode and the other end electrically connected to a corresponding one of said printed wirings of said printed-wiring board;

a third lead conductor extending from said third electrode and having a tip end electrically connected to a corresponding one of said printed wirings of said printed-wiring board by a mechanical solderless connection using a clamping member.

16. A three-electrode type electroluminescent lamp comprising:

a transparent electrode;

a backing electrode;

an electroluminescent body sandwiched between said transparent electrode and said backing electrode;

a first lead conductor having a base end portion laid over and electrically connected to an edge region of said transparent electrode;

a second lead conductor having a base end connected to said backing electrode;

a third electrode in the form of a plate laid over said backing electrode and electrically insulated from said backing electrode; and a third lead conductor extending from said third electrode, the third lead conductor extending outwardly from an edge of said third electrode near to the edge region of said transparent electrode connected to said base end portion of said first lead conductor so as to be offset and free from contact with the edge region of said transparent electrode on which the base end portion of said first lead conductor is laid and also to extend along and overlay said first lead conductor excluding the base end portion.

* * * * *